US005540544A

United States Patent [19]

Sacerdoti et al.

[11] Patent Number: 5,540,544

[45] Date of Patent: Jul. 30, 1996

[54] INTERMEDIATE SHEET STORAGE MEANS

[75] Inventors: Cesare Sacerdoti; Ottavio Terzoli, both of Milan, Italy

[73] Assignee: Logitron S.R.L., Firenze, Italy

[21] Appl. No.: 305,036

[22] Filed: Sep. 13, 1994

[51] Int. Cl.[6] ..... B65H 31/30

[52] U.S. Cl. ..... 414/790.7; 902/12; 271/265.02; 271/303; 271/902; 271/290; 271/301

[58] Field of Search ..... 414/790.7; 271/265.02, 271/265.01, 266, 298, 300, 301, 303, 213, 176, 902; 902/12, 13, 14, 15, 36

[56] References Cited

U.S. PATENT DOCUMENTS

| | | | |
|---|---|---|---|
| 4,524,268 | 6/1985 | Fukatsu | 902/12 |
| 4,571,489 | 2/1986 | Watanabe | 902/12 |
| 4,625,870 | 12/1986 | Nao et al. | 902/12 |
| 4,693,464 | 9/1987 | Honma | 271/265.02 |
| 5,135,212 | 8/1992 | Utsumi et al. | 271/265.01 |
| 5,152,512 | 10/1992 | Yoshida et al. | 271/213 |
| 5,155,603 | 10/1992 | Seok-Jae | 271/265.02 |

FOREIGN PATENT DOCUMENTS

| | | |
|---|---|---|
| 0514618 | 11/1992 | European Pat. Off. . |
| 2619620 | 1/1977 | Germany . |

*Primary Examiner*—H. Grant Skaggs
*Attorney, Agent, or Firm*—Thomas R. Vigil

[57] ABSTRACT

An intermediate sheet storage device which comprises: controlling and checking apparatus (19) and signalling device (18) provided for the control of at least two groups of belt conveyors which embody a predetermined path provided for being followed by a sheet (4) during its handling. Particularly, the sheet (4) is forced to take a curvilinear shape along the path, the same shape taken by the groups of belt conveyors. Moreover, the storage device comprises a first diverting element (16) and a second diverting element (17), each of these is arranged to take a first position that allows the sheet (4) to follow a predetermined path as far as a dwell position (15) and a second position that diverts the sheet from its path and sends the sheet or stack of sheets to a collecting cassette (6) or to an outlet slot (7) for returning it to the user.

12 Claims, 3 Drawing Sheets

INTERMEDIATE SHEET STORAGE MEANS

The present invention relates to an intermediate sheet storage device, in other words a device for collecting sheets, particularly banknotes, for keeping or giving them back to a user. The storage device is incorporated within equipment for accepting sheets and/or banknotes of different sizes, which are provided for automated transaction such as, for example, for dispensing tickets in railway and bus stations, for the gas deliver in automatic pumps of gas stations, etc..

As it is known, the above mentioned commercially available equipments basically consist of a body, wherein there is a sheet receiving device, an intermediate storage device connected to a sheet collecting cassette and a controlling and checking device provided for receiving instructions from a user, who wants to take advantage of the service provided by the equipment.

In particular, the controlling and checking device is arranged to process the instructions received from the user, to send command signals to the receiving device, to the intermediate storage device and to one or more service dispensers connected to the equipment itself.

The previously disclosed equipment do not allow a transaction, once initiated, to be interrupted and any sheets or banknotes deposited to be recovered. Instead the sheets or banknotes are kept without delivering the service.

Another disadvantage present in some of the previously disclosed equipment is that the sheets, along the path they follow inside the equipment itself, are mechanically stressed so that they are subjected to abrasions and also to tearings in addition to relative sliding with consequent misalignments which restrict the correct handling of the sheets collected in the intermediate storage device.

Moreover, it occurs that after several passages of the sheets over sensors located in the equipment the sensors performance degrade due to the presence of ink, dust or other substances present on the sheets and released on the sensors themselves.

In particular, the Applicant is aware of the German patent No. 2619620, wherein there are described storage devices for a short term collection of paper sheets. These storage device provide that the sheets, already stacked, are held in a packet between belt conveyors and are slid back and forward.

The mentioned storage devices have the shortcoming of mechanically stressing the sheets because of the relative movement of the belts. This is due to the fact that the sheets must follow a fairly long straight path that promotes the sliding between the sheets and between the belts, with consequent disruption of the pile and abrasion of the sheets, as it occurs in the prior art equipments.

The Applicant also knows of a Swiss patent (No. 1392) that shows intermediate storage device arranged to pile sheets after a taking cycle which comprises two off steps and two receiving steps and a transporting cycle. In particular, the intermediate storage device is arranged for piling consecutively received sheets into a pile that stays stationary during the sheet storing step. The pile is moved to a sheet collecting cassette or to an element for returning the sheets only after all the sheets have been received.

The storage device comprises a handling device formed by a plurality of motors driving a large number of rollers which, engaging different belts, forms two very complicated sheet transporting paths.

The storage device additionally comprises a rail provided with a trolley for moving sheets and a plurality of belt conveyors for forming the sheet transporting path.

Also the just described storage device has some disadvantages, for example, the structural complexity, the necessity of several components, in addition to a long winding sheet path, etc..

It is an object of the present invention to substantially solve the problems of the known prior art by overcoming the above mentioned difficulties by means of an intermediate sheet storage device to be introduced in equipment which provides for receiving sheets and/or banknotes and for controlling the delivery of a service, wherein the storage device is able to provide the sheet and/or banknote storage and consequently to receive or return them to the user of the equipment.

It is another object of the present invention to provide a storage device capable of insuring an easy handling of sheets and/or banknotes along a path having a reduced size.

It is another object of the present invention to provide a storage device which provides that all movements of the sheets and/or banknotes occur without sliding, both among the sheets within a stack and between the belts that hold them.

It is a further object of the present invention to provide a storage device which is easy to manufacture and provide good operating performance, and which allows a decrease of the manufacturing costs and times by making use of standard components.

These and further objects, which will be more apparent from the following present description, are substantially achieved by the sheet intermediate storage device as claimed.

Further features and advantages will be more apparent from the detailed description of the intermediate sheet storage device according to the present invention described as follows with reference to the accompanying drawings given only as illustrative and therefore not intended to be limiting, wherein.

With reference to the above mentioned figures, 1 generally designates an intermediate sheet storage device, according to the present invention.

Figure 1:
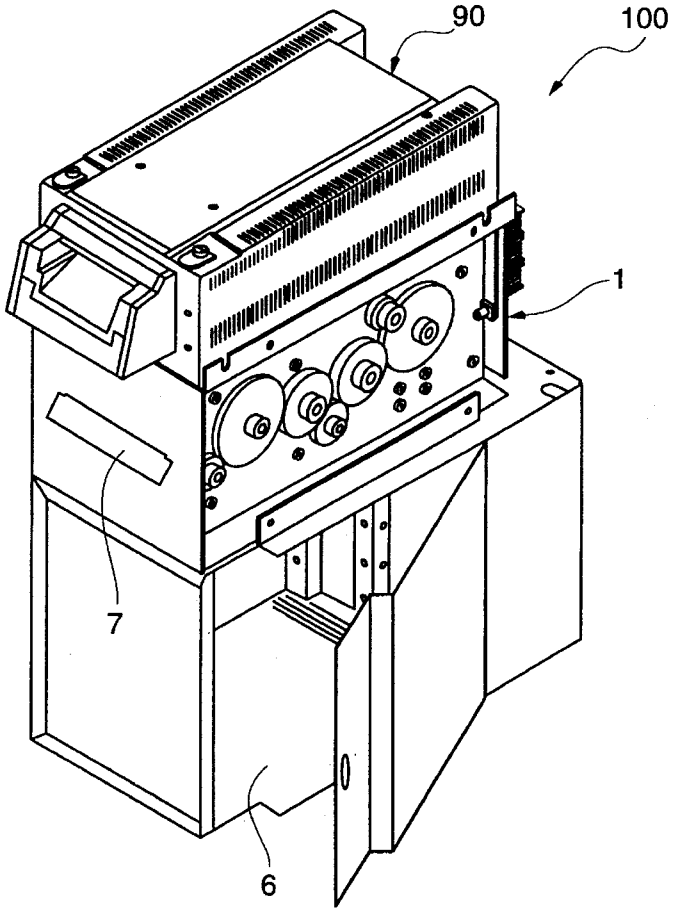
FIG. 1 is a perspective schematic view of the intermediate sheet storage device

The storage device 1 is inserted in equipment 100 which comprises substantially a receiving device 90 for receiving sheets and/or banknotes and one or more devices (not shown in FIG. 1 because they are known) which provide for delivering a particular service.

Particularly, the storage device 1 has a mounting structure 2 having an inlet slot 3 provided for allowing the introduction of a sheet or a banknote 4 to be stored, a cashing outlet 5 whereby one banknote 4 or packet 4*a* of banknotes is transferred in a collecting cassette 6 connected to the mounting structure 2 and an outlet slot 7 provided for the outlet of the banknote 4 or the packet 4*a*.

Figure 2:
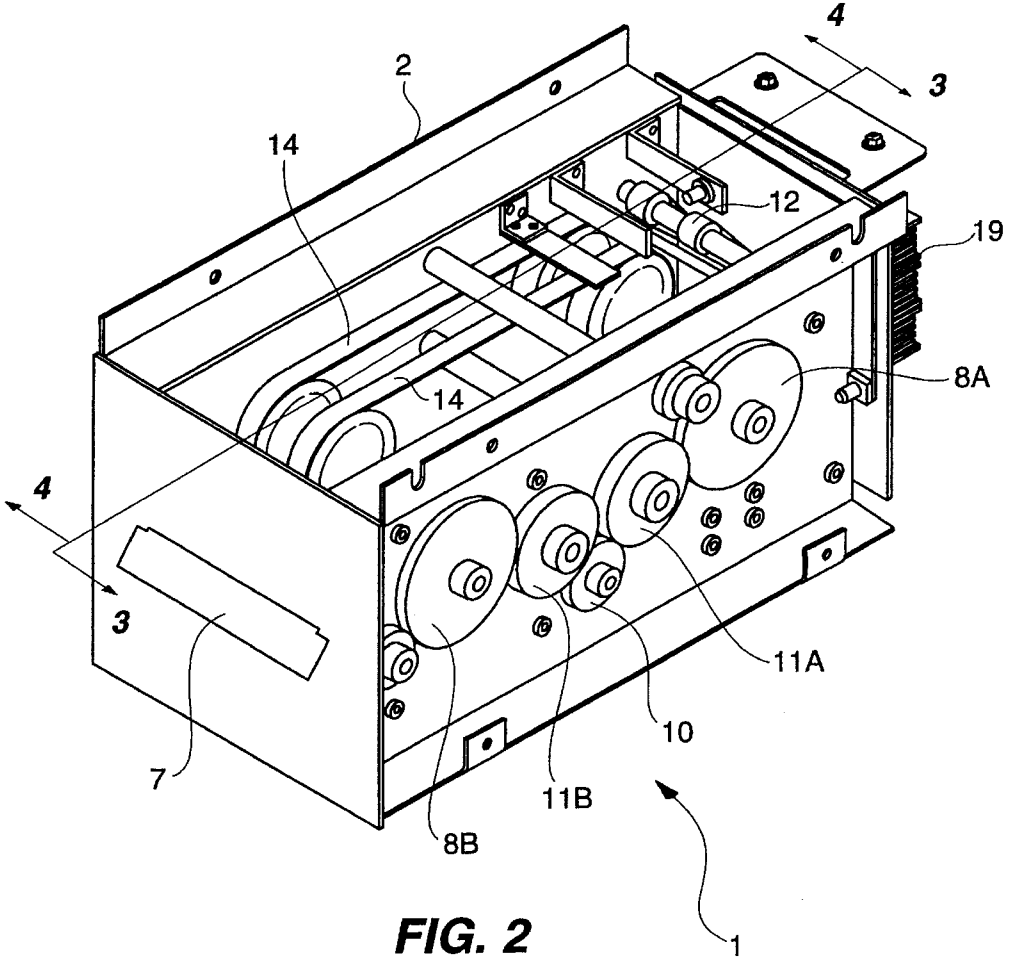
FIG. 2 is a cross-sectional schematic view of intermediate sheet storage means
Figure 3:
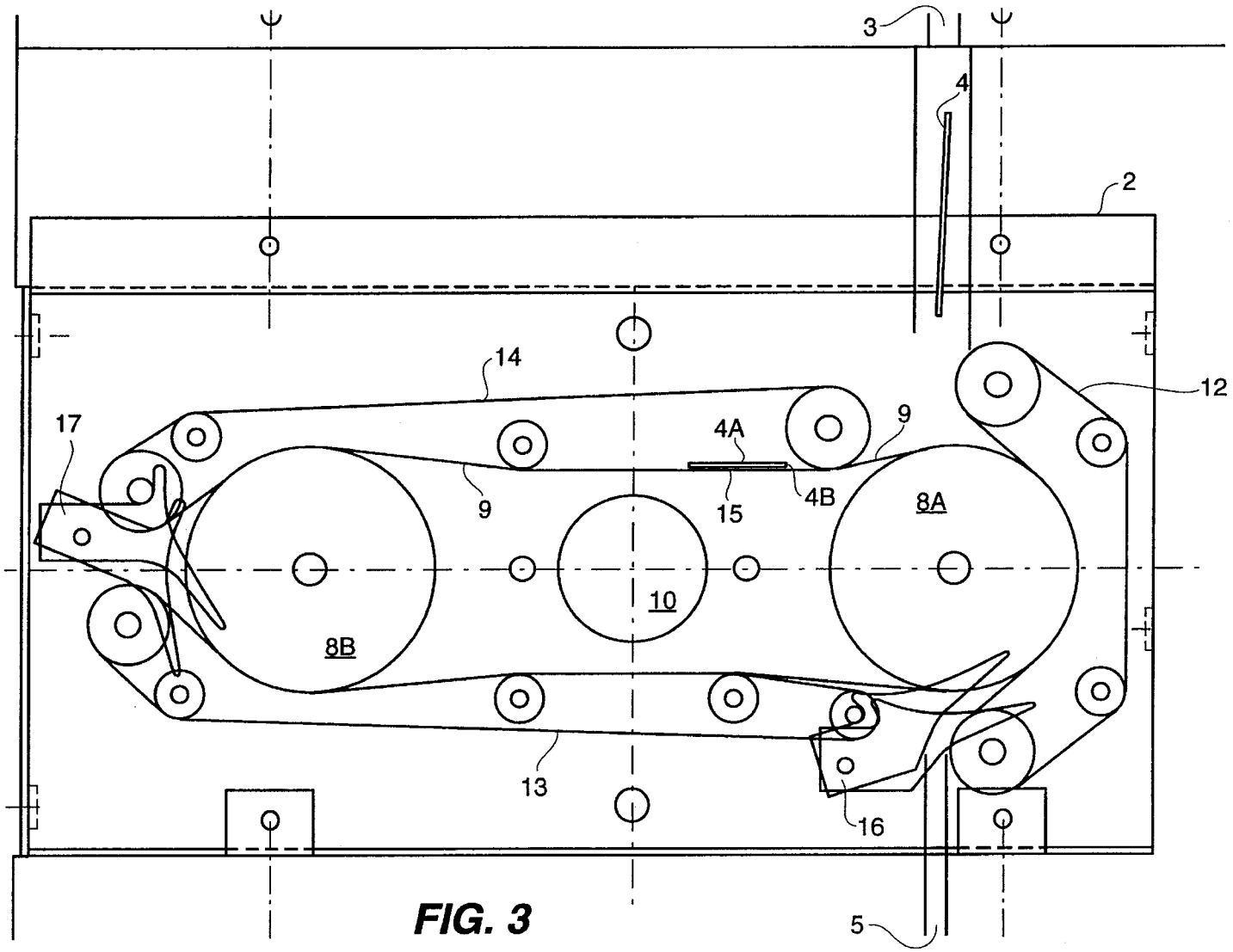
FIG. 3 is a cross-sectional schematic view of the intermediate sheet storage device along the line III—III of FIG. 2
Figure 4:
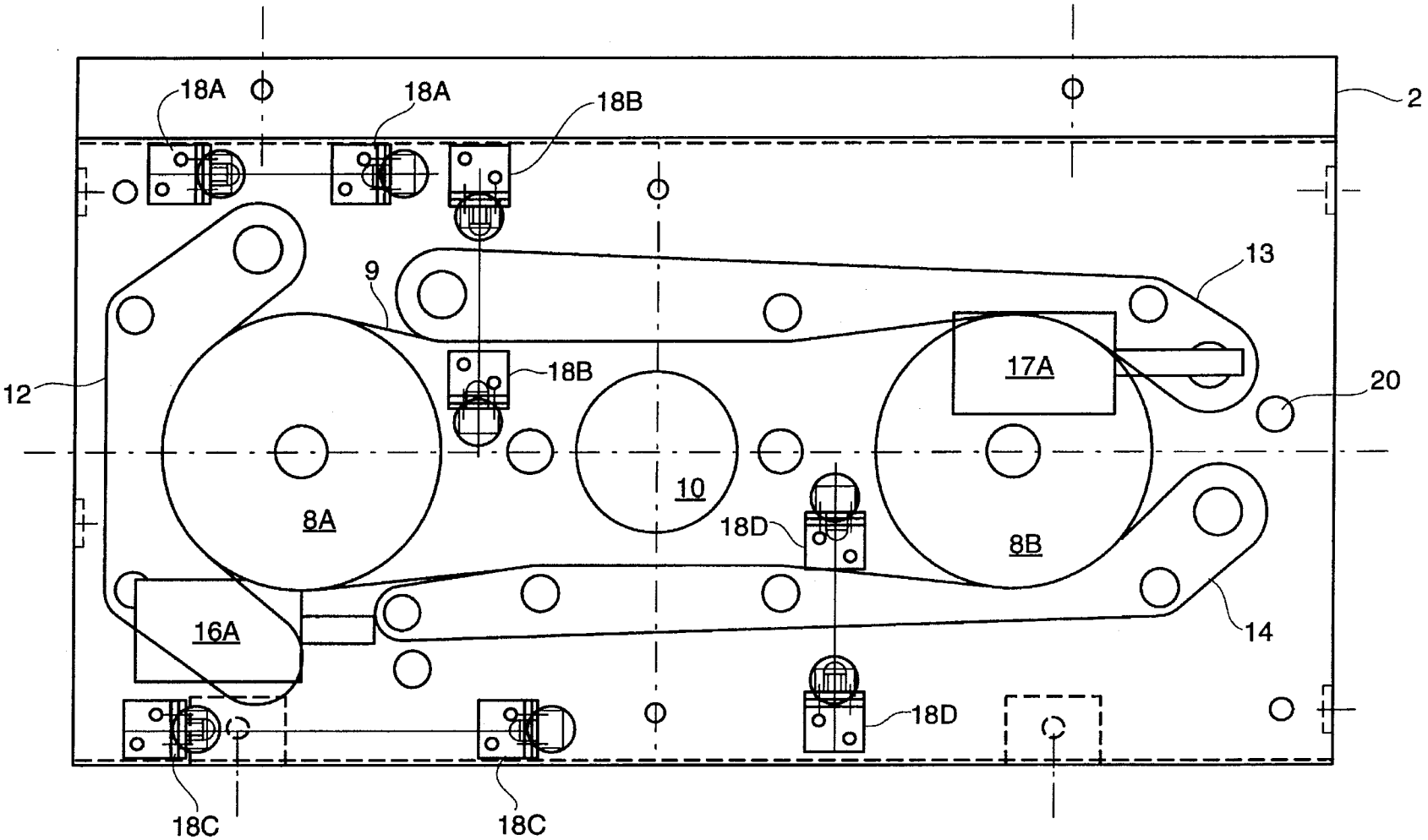
FIG. 4 is cross-sectional schematic view of the storage device along the line IV—IV of FIG. 2.

The storage device 1 comprises a first pulley 8*a* and a second pulley 8*b* which are both engaged by a first belt conveyor 9, as shown in FIG. 3, and rotated by driving device 10, as shown in FIG. 2.

Particularly, the driving means 10 are formed by a small drive motor that is engaged by a pair of gear wheels 11*a* and 11*b* connected to the pulleys 8*a* and 8*b* respectively.

The storage device means 1 has a second belt conveyor 12 which is in contact with the first belt conveyor 9 in the part of the storage device 1 located between the inlet slot 3 and the cashing slot 5, a third belt conveyor 13 which is in contact with the first belt conveyor 9 in the part of the storage device 1 located substantially between the cashing slot 5 and the outlet slot 7 and a fourth belt conveyor 14 which is in contact with the first belt conveyor 9 in the part of the storage located between the outlet slot 7 and the inlet slot 3 in correspondence of a dwell position 15 for the banknote 4 or for the packet 4*a* of banknotes which is formed by piling up the banknotes themselves.

With further details, the dwell position 15 is provided for placing an additionally received banknote 4 on the other banknotes already piled into a packet 4*a*.

As a matter of fact, it is provided that the edge 4*b* of the packet 4*a* stops in a known position so that, when the next banknote enters, the edges of the minor side of both the banknote and the packet can be aligned. Although different sizes, each banknote of the packet 4*a* shows its leading edge aligned with the leading edges of the underlying banknotes along with the leading edge of the first banknote of the packet which is stopped in the dwell position 15.

The storage device 1 further comprises a first diverting element 16 adjacent the cashing slot 5 between the conveyors 12 and 13 and driven by a first electromagnet 16*a*. The diverting element 16 is arranged to take a first position, wherein it allows the banknote 4 or the packet 4*a* to follow a prefixed path as far as the dwell position 15 and a second position, wherein it diverts the banknote 4 or the packet. 4*a* from its path and send it to a collecting cassette 6.

Similarly, it is provided a second diverting element 17 located adjacent the outlet slot 7 between the conveyors 13 and 14 and driven by a second electromagnet 17*a*. The diverting element 17 is also arranged for taking a first position wherein it allows the banknote 4 or the packet 4*a* to follow the prefixed path as far as the dwell position 15 and a second position wherein it diverts the banknote itself or the packet 4*a* from its path and sends it to the outlet slot 7.

According to the present embodiment, the storage device comprises a signalling device which comprises a plurality of sensors arranged for signalling the passage of the banknote 4 or the packet 4*a* during its handling.

Particularly, the plurality of sensors are positioned with a first sensor 18*a* located adjacent the input slot 3 and provides for signalling the receiving of the banknote 4, a second sensor 18*b* located adjacent the dwell position 15 and arranged for signalling the arrival of the banknote 4 or the packet 4*a* during the piling of the banknotes, a third sensor 18*c* located adjacent the first diverting element 16 and provides for informing the controlling and checking apparatus 19 of the occurence of the passage of the banknote or the packet in the collecting cassette 6 and a fourth sensor 18*d* located adjacent the second diverting means 17 and provides for informing the the controlling and checking apparatus 19 of the passage of the banknote or packet to the oulet slot 7 in case the transaction is stopped and the banknote 4 or the packet 4*a* is returned.

According to the present invention, the controlling and checking apparatus 19 comprises a microprocessor capable of the receiving and interpreting of signals sent from the sensors 18*a*, 18*b*, 18*c* and 18*d*, the control of the operation of the two electromagnets 16*a*, 17*a* for handling the two diverting elements 16 and 17, the operation of the drive motor 10, such as the turning on, the turning off and the direction of rotation. In addition to that the controlling and checking apparatus 19 receive and executes the commands from the user.

The storage device 1 further includes, near the outlet slot 7, a microswitch 20 provided for signalling the controlling and checking apparatus 19 in the event the user is exerting a light pull for taking out the banknote 4 or the packet 4*a*, that is held between the conveyors 9 and 13. With further details, the banknotes 4 or the packet 4*a* are always handled between two pairs of conveyors which run at the same speed and take a curvilinear shape along the path (the same shape taken by the belts of the conveyors on the pulleys) reducing the length of the straight portions of the path and keeping flexed the banknotes 4 or the packet 4*a*, including the banknotes of smaller size. Thanks to this kind of path and to the same speed between the conveyors it is possible to insure the absence of the sliding among the banknotes or between one of the two conveyor and the banknotes. In this way, the banknote is not stressed neither by rubbing nor by traction, and the tearings that occurred in the prior art are avoided.

According to the present invention, the pulleys used in the storage device are of the barrel type. The use of pulleys without rims help eliminate the break of the edges of the belts of the conveyors resulting in an improved life and efficiency of the belt conveyors.

Moreover, the belt conveyors carried out by a resilient belt, move at the same speed, in other words, the speed of the inner belt is equal to that of the outer belt. In this way, the banknote 4 is always and simultaneously compressed by belts on both sides.

According to the present embodiment, the storage device 1 has two groups of belt conveyors 9, 12, 13 and 14 arranged parallely to one another with the corresponding pulleys 8*a* and 8*b*, gear wheels 11*a* and 11*b*, etc., as shown in FIG. 2.

After having described the invention in a mainly structural way, its operation is as follows.

A banknote 4 is inserted through the inlet slot 3, which, being supported between the groups of belt conveyors and held between the belts 9 and 12, 9 and 13 and 9 and 14 respectively, follows a predetermined path until it arrives in the dwell position 15 waiting the insertion of a next second banknote 4 and its alignment along the leading edge with the other banknote in the dwell position in order to form a packet 4*a* of banknotes. In particular, the banknote 4 is caused to take a curvilinear shape along the length of the path, the same shape taken by the belts on the pulleys.

The sensor 8*a*, present in the inlet slot 3, signals the introduction of the banknote 4 and sends a signal to the controlling and checking apparatus 19 which operates the turning on of the motor 10, that rotates the pulleys and the belts. The motor speed and motor turn on time is coordinated with the signals received from the sensors so that the leading edge of banknote 4, being introduced, aligns with the leading edge of the packet 4*a*. The packet 4*a* and the newly introduced banknote 4 travel together, cycling through the predetermined path, until they both reach the dwell position 15.

Every time a banknote 4 is introduced, the packet 4*a* follows the predetermined path between the belts and, when the packet reaches the dwell position 15, the belt conveyors stop and stay in the waiting mode ready for receiving another new banknote 4 to put on.

Once the banknote receiving step has ended, the banknote discharge step begins.

The discharge step provides that the banknotes 4 or the packet 4*a* is deposited in the collecting cassette 6 or sent to the outlet slot 7 for returning them to the user.

In the event the discharge step provides for the deposit of the packet 4*a* in the collecting cassette 6, the controlling and checking apparatus 19 operates the first diverting means 16 which takes the second position and operates the motor 10 to rotate the belt conveyor clockwise. So, the banknotes pass in front of the diverting element 16 which guides them outside downwardly to the cashing slot 5. The sensor 18*c* checks and confirms the banknotes have been discharged through the cashing slot 5 in the collecting cassette 6.

Once the step has ended, the electromagnet 16*a* is de-energized and the storage device 1 returns to the initial state ready to receive other banknotes.

Otherwise, in the event the discharge step provides for the return of the banknotes which are in the dwell position 15, the controlling and checking apparatus 19, after having received a command from the user, who keyed a returning instruction on the keyboard for the microprocessor of the controlling and checking apparatus 19, will transmit a series of instructions for controlling the handling of the banknotes towards the outlet slot 7.

Once the instruction has been received, the motor 10 rotates the belt conveyor 9 and the banknote packet 4*a* clockwise, the electromagnet 17*a* is energized which in turn drives the second diverting element 17 to the second position in order to send the banknotes to the outlet slot 7. The fourth sensor 18*d* signals the passage of the banknotes and stops the belt conveyor 9 after this passage, so the banknotes 4 arrive at the outlet slot 7 to be withdrawn.

The banknotes are moved to the outlet slot 7 so that a small portion projects from the slot allowing the user to grasp them.

At this point, the motor 10 stops and the banknotes are held between the groups of belt conveyor 9 and 13. After the user has applied a traction action on the banknotes, a signal is sent, by means of the microswitch 20 to the controlling and checking apparatus 19 which activates the motor 10 clockwise and the banknotes are completely expelled.

If the user fails to withdraw the banknotes 4 or the packet 4*a* after a predetermined time, the pulleys 8*a* and 8*b* start rotating counterclockwise and the banknotes are pulled back past the sensor 18*d* while the electromagnet 17*a* returns diverting element 17 to the first position and the banknotes 4 or the packet 4*a* are returned to the dwell position. In this way, the banknotes can start rotating again and can be discharged in the collecting cassette 6 by the diverting element 16.

During the banknote return step and during the discharge step in the collecting cassette 6, a signal stops the receiving of other banknotes through the inlet slot 3. The present invention obtains the desired objects.

In fact, the intermediate sheet storage device 1 allows for the stacking of a number of banknotes without tearing them, suffering mechanical stresses and sliding between each other. This is due to the belts of the conveyors used. Since the belts are resilient they help in blocking the banknotes and permit the banknotes to be always held and contained between the belts themselves so that there is no side skid. Moreover, the size of the banknote path is reduced and mainly curvilinear thus promoting the stability of the banknotes.

In addition to that, the storage device 1, according to the present invention, allows the banknotes to be recovered by the user, if he/she decides to cancel transaction and the banknotes to be stored if the user decides to not withdraw them through the outlet slot.

Advantageously, the storage device 1 shows a surprising structural simplicity and a fast manufacturing due to the presence of shared pieces which make up the mounting structure, and the use of commercially available elements, in addition to the reasons outlined above. The presence of a limited number of components such as the belt conveyors, pulleys, gear wheels, etc., allows for reduced manufacturing cost and allows for a shorter manufacturing time.

The storage device 1 has a reduced size so that the storage device can be easily included in known equipments.

Obviously, one can add to the present invention several modifications and alternatives, without departing from the scope of the inventive step that characterize it.

We claim:

1. Intermediate sheet storage means, of the type comprising a mounting structure (2) provided with an inlet slot (3) arranged for allowing the insertion of a sheet (4) to be stacked, a cashing slot (5) through which the sheet (4) is transferred to a collecting cassette (6) connected to the mounting structure (2) and an outlet slot (7) provided for the exit of the sheet (4), said intermediate sheet storage means including:

at least two groups of belt conveyors engaged by a plurality of pulleys rotatively operated by a driving means (10) and providing a predetermined path arranged for being followed by the sheet (4) during its handling, the sheet (4) having a curvilinear shape along said path, the same shape taken by said groups of belt conveyors, a first diverting element (16) positioned adjacent the cashing slot (5) and arranged for taking a first position wherein said first diverting element (16) allows the sheet (4) to follow a predetermined path as far as a dwell position (15) and a second position wherein said first diverting element (16) diverts the sheet (4) from said predetermined path and sends the sheet to the collecting cassette (6), a second diverting element (17) positioned adjacent the outlet slot (7) and arranged for taking a first position wherein said second diverting element (17) allows the sheet (4) to follow said predetermined path as far as said dwell position (15) and a second position wherein said second diverting element (17) diverts the sheet (4) from said predetermined path and sends the sheet to the outlet slot (7) for returning the sheet to a user, a controlling and checking means (19) provided for the control of commands received from the user, the handling of said group of belt conveyors and the collection or the return of the sheet (4), and a signalling means (18) arranged for signalling the passage of the sheet (4) during handling of the sheet (4) along said predetermined path.

2. Intermediate sheet storage means according to claim 1, wherein each group of said belt conveyors substantially comprises:

a first belt conveyor (9) engaged by a first pulley (8*a*) and by a second pulley (8*b*), a second belt conveyor (12) which is coupled with a portion of said first belt conveyor (9) between the inlet slot (3) and the cashing slot (5), a third belt conveyor (13) which is coupled with a portion of said first belt conveyor (9) between the cashing slot (5) and the outlet slot (7), a fourth belt conveyor (14) which is coupled with a portion of said first belt (9) between the outlet slot (7) and the inlet slot (3).

3. Intermediate sheet storage means according to claim 1, wherein said signaling means (18) comprises a plurality of sensors.

4. Intermediate sheet storage means according to claim 3, wherein said plurality of sensors comprises:

a first sensor (18*a*) located adjacent the inlet slot (3) and provided for signalling the receiving of the sheet (4), a second sensor (18*b*) located adjacent said dwell position (15) and arranged to signal the arrival of the sheet (4), a third sensor (18*c*) located adjacent said first diverting element (16) and provided to signal said control and checking means (19) the passage of the sheet (4) into the collecting cassette, a fourth sensor (18*d*) located adjacent of said second diverting element (17) and provided to signal said controlling and checking means (19) that the passage of the sheet (4) has occurred to the outlet slot (7) in case of the return of the sheet.

5. Intermediate sheet storage means according to claim 4, wherein said dwell position (15) comprises a stop line provided for aligning the leading edge of each banknote controlled by said controlling and checking means (19) by the signal from said second sensor (18*b*).

6. Intermediate sheet storage means according to claim 1, wherein said driving means (10) comprises a drive motor provided for the handling of said groups of belt conveyors.

7. Intermediate sheet storage means according to claim 6, wherein said drive motor is engaged by a pair of gear wheels (11*a* and 11*b*) engaged by said plurality of pulleys.

8. Intermediate sheet storage means according to claim 1, wherein said first diverting element (16) is positioned in one of said first position and said second position by an electromagnet (16*a*) operated by said controlling and checking means (19).

9. Intermediate sheet storage means according to claim 1, wherein said second diverting element (17) is positioned in one of said first position and said second position by an electromagnet (17*a*) operated by said controlling and checking means (19).

10. Intermediate sheet storage means according to claim 1, wherein said controlling and checking means (19) comprises a microprocessor capable to deal with the monitoring, the storing and sensing of signals sent by said signalling means (18), for controlling the positioning of said first and said second diverting elements (16 and 17), the operating of said driving means (10), and to receive and to execute the commands coming from the user.

11. Intermediate sheet storage means according to claim 1, wherein said intermediate sheet storage means additionally comprises a microswitch (20) provided for signalling said controlling and checking means (19) when a light pull, exerted by the user, on the portion of the sheet (4) exiting from the outlet slot (7) is detected.

12. An intermediate sheet storage means for providing intermediate storage of one or more sheets received during a transaction comprising:

an input slot through which one or more sheets are received from a user;

a cashing slot through which the one or more sheets are deposited into a collecting cassette, upon completion of the transaction;

an output slot through which the one or more sheets are returned to the user, if the transaction is interrupted prior to completion;

a transport mechanism having a cyclical curvilinear path and defining a predetermined path for transporting said one or more sheets received through said input slot along said predetermined path;

a first diverting element having a first position wherein the one or more sheets are allowed to travel along said predetermined path and a second position wherein said first diverting element redirects the one or more sheets through said cashing slot;

a second diverting element having a first position wherein the one or more sheets are allowed to travel along said predetermined path and a second position wherein said second diverting element redirects the one or more sheets through said output slot; and a controlling and checking means coupled to said transport mechanism, for controlling the speed and the direction of travel of said transport mechanism, and for controlling said first and said second diverting elements, based on instructions received from the user.

* * * * *